US006006647A

United States Patent [19]

Van Winkle

[11] Patent Number: 6,006,647

[45] Date of Patent: Dec. 28, 1999

[54] ACTUATOR WITH FREE-FLOATING PISTON FOR A BLOWOUT PREVENTER AND THE LIKE

[75] Inventor: Denzal Wayne Van Winkle, Santa Maria, Calif.

[73] Assignee: Tuboscope I/P Inc., Conroe, Tex.

[21] Appl. No.: 09/074,867

[22] Filed: May 8, 1998

[51] Int. Cl.[6] ..... F15B 15/26

[52] U.S. Cl. ..... 91/41; 92/28

[58] Field of Search ..... 92/20, 21 R, 22, 92/27, 28, 24; 91/43, 44, 45, 41

[56] References Cited

U.S. PATENT DOCUMENTS

| | | | |
|---|---|---|---|
| 736,778 | 8/1903 | Reason | 92/23 |
| 2,876,746 | 3/1959 | Storrs | 92/28 |
| 2,889,895 | 6/1959 | Snow | 92/28 X |
| 3,033,171 | 5/1962 | Engelbrecht et al. | 92/27 X |
| 3,208,357 | 9/1965 | Allen et al. | 92/27 |
| 4,116,113 | 9/1978 | Leclerc | 92/24 |
| 4,240,332 | 12/1980 | Deutsch | 92/27 X |
| 4,531,422 | 7/1985 | Yarnell | 92/27 X |
| 4,601,232 | 7/1986 | Troxell, Jr. | 92/24 |
| 4,690,033 | 9/1987 | Van Winkle | 91/43 |
| 4,784,037 | 11/1988 | Fabyan et al. | 92/27 X |
| 4,969,627 | 11/1990 | Williams, III | 92/24 X |

FOREIGN PATENT DOCUMENTS

| | | | |
|---|---|---|---|
| 697988 | 11/1979 | Russian Federation | 92/27 |

*Primary Examiner*—John Ryznic
*Attorney, Agent, or Firm*—Gunn & Associates, P.C.

[57] ABSTRACT

A method and apparatus for operating a fluid actuated actuator between one and another alternate positions provides different forces for locking and unlocking the actuator. The actuator may use the same fluid pressure to operate a primary piston within a cylinder and to operate the locking mechanism. Actuator fluid is communicated to unlock the lock member and to move the piston back to its open or unactuated position. A sequencing valve determines the proper sequence of actuating the primary piston before the locking mechanism is driven in place, and clearing the locking mechanism prior to reciprocating the piston back to its unactuated position. Different forces for locking and unlocking the locking mechanism is provided by a free-floating piston mounted on a guide rod. The invention may also be applied to a BOP or the like where different opening and closing forces are desired.

13 Claims, 9 Drawing Sheets

ACTUATOR WITH FREE-FLOATING PISTON FOR A BLOWOUT PREVENTER AND THE LIKE

FIELD OF THE INVENTION

The present invention relates generally to the field of hydraulic actuators and, more particularly, to an actuator with a free-floating piston on a guide rod to control axial thrust.

BACKGROUND OF THE INVENTION

An actuator of the type to which the present invention relates is shown and described in U.S. Pat. No. 4,690,033 to Van Winkle. This patent is incorporated herein by reference. The actuator of the '033 patent includes an arrangement for reciprocating a piston in a cylinder between alternate positions. It uses the same hydraulic fluid to power a blowout preventer (BOP) ram actuator piston to move the rams of the BOP to the open or closed position, and to power the pistons of a wedge locking mechanism to the locked or unlocked position.

The actuator shown and described in the '033 patent has been commercially successful and is still sold today. A modified version of the actuator of the '033 patent is depicted in FIGS. 5*a* and 5*b* of this disclosure. The structure and function of this actuator will be described below in greater detail, but suffice it to say here that the actuator includes a rubber diaphragm which separates ambient seawater from hydraulic fluid within the actuator.

Recently introduced hydraulic fluid has a specific gravity that is greater than that of seawater so that, if the actuator develops a leak, then hydraulic fluid will leak out of the actuator and no seawater will leak in. The disadvantage of having hydraulic fluid that is heavier than seawater is that the hydrostatic head of the hydraulic fluid tends to release the wedge which is locking the BOP ram actuator piston in the closed position.

Thus, there remains a need for an actuator of proven reliability that functions properly at extreme depths so that the locking mechanism remains in a locked position if no hydraulic pressure is applied to the hydraulic fluid of the actuator. Such an actuator should operate properly in all phases of operation, despite the fact that the specific gravity (and thus the hydrostatic head) of the column of hydraulic fluid is heavier than the ambient seawater. Such an actuator should also operate properly regardless of the relative specific gravitates of the hydraulic fluid and ambient environment.

Aside from locking actuators, the design of blowout preventer (BOP) hydraulic operators is frequently a compromise between the strength of the ram attachment for retracting the ram from a closed position, and the force required to close the ram. Closing forces against the ram are transmitted mainly by way of the larger flat end area of the piston rod. Opening forces must be transmitted by way of the weaker, smaller area provided by means of grooves or threads. There are two times when this deficiency is particularly critical: (1) when high forces are required for shearing pipe; and (2) when the operator attempts to open the rams under pressure without first equalizing well pressures.

Shearing pipe requires a great force and consequently a large diameter cylinder which encloses the ram piston. When a large diameter cylinder is used, retracting forces may be excessive, and cause failure of the ram, and/or the piston rod.

Opening rams without first equalizing well pressure is critical since well pressure tends to keep the rams closed, and all hydraulic opening forces pull on the weaker connection between the ram and the piston rod.

While it is desirable to have the greater force closing the ram, the mechanical design criteria dictate that the opening force is always greater, when at operating well pressure.

Thus, there remains a need for a hydraulic actuator for a BOP that can provide the high force necessary for proper ram action, such as shearing a pipe, while providing an opening force that will not damage the BOP.

SUMMARY OF THE INVENTION

The present invention addresses these problems in the prior art of the actuator of the wedge-type locking mechanism by incorporating a free-floating piston. The free-floating piston provides the desired higher force to unlock the wedge, and a lesser force to lock the wedge, while maintaining the wedge actuator filled with hydraulic fluid, eliminating the potential imbalance caused by the hydrostatic differential between ambient sea water, and hydraulic fluid.

In the case of the actuator of the wedge-type locking mechanism, the free-floating piston prevents the wedge from unseating if the hydrostatic head of hydraulic actuator fluid exceeds that of ambient seawater. This structure permits a design wherein the entire wedge cavity is filled with hydraulic operating fluid, and therefor any variation in the hydrostatic head of sea water is inconsequential. If the piston herein described were not free-floating, the wedge would be set with such a high force that the unlocking force might not be adequate to unlock the wedge.

The present invention also addresses the problems in the prior art of the BOP actuators. In the embodiment of the application of this invention to BOP actuator piston, the free-floating piston permits the design of a high force for actuating the ram of the BOP and a lower force for retraction of the ram.

These and other features of the present invention will be apparent to those of skill in the art from a review of the following detailed description along with the accompanying drawings.

DETAILED DESCRIPTION OF PREFERRED EMBODIMENTS

Figure 1:
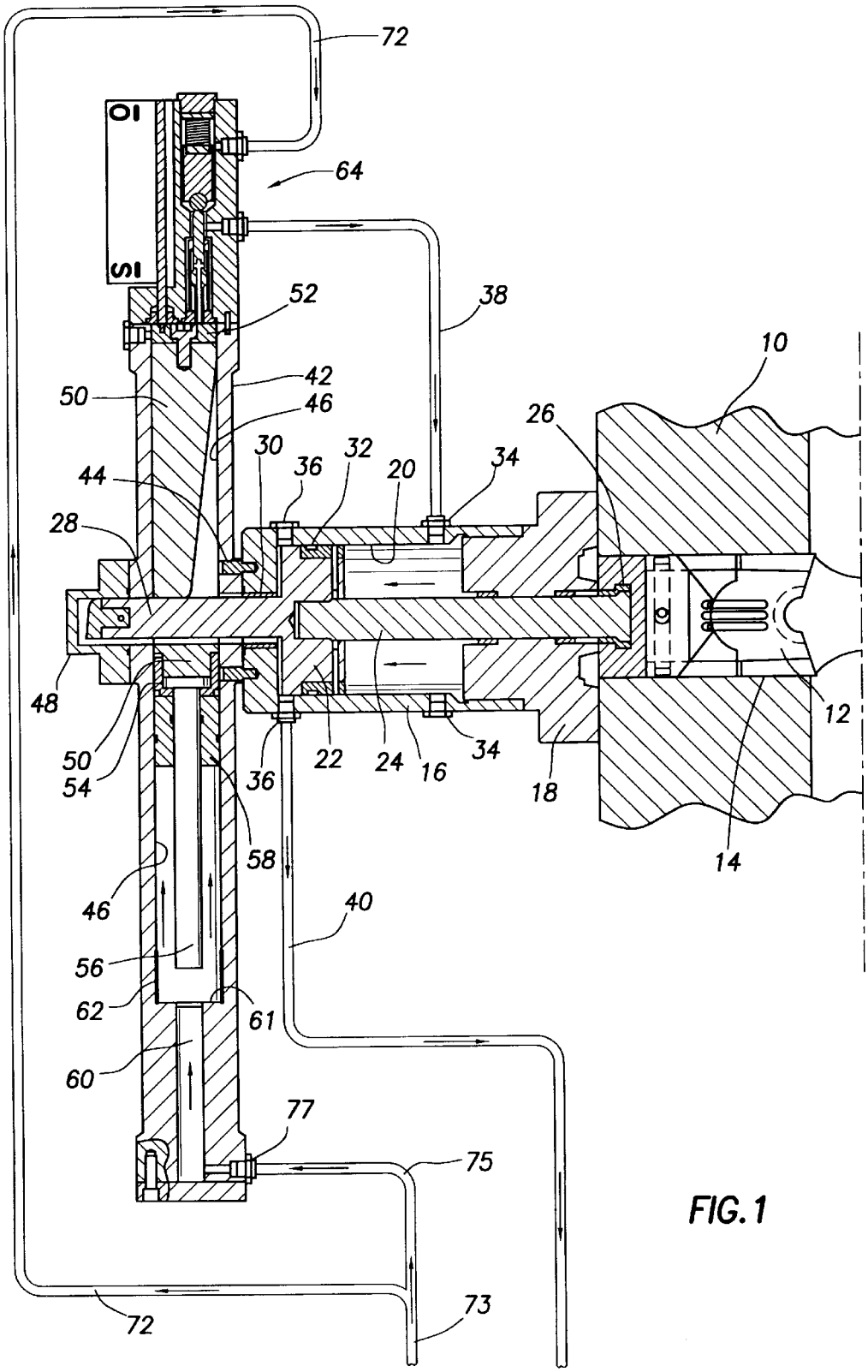
FIG. 1 is a top section view of an actuator of the present invention with a ram in the open position with a locking mechanism oriented horizontally.
Figure 2:
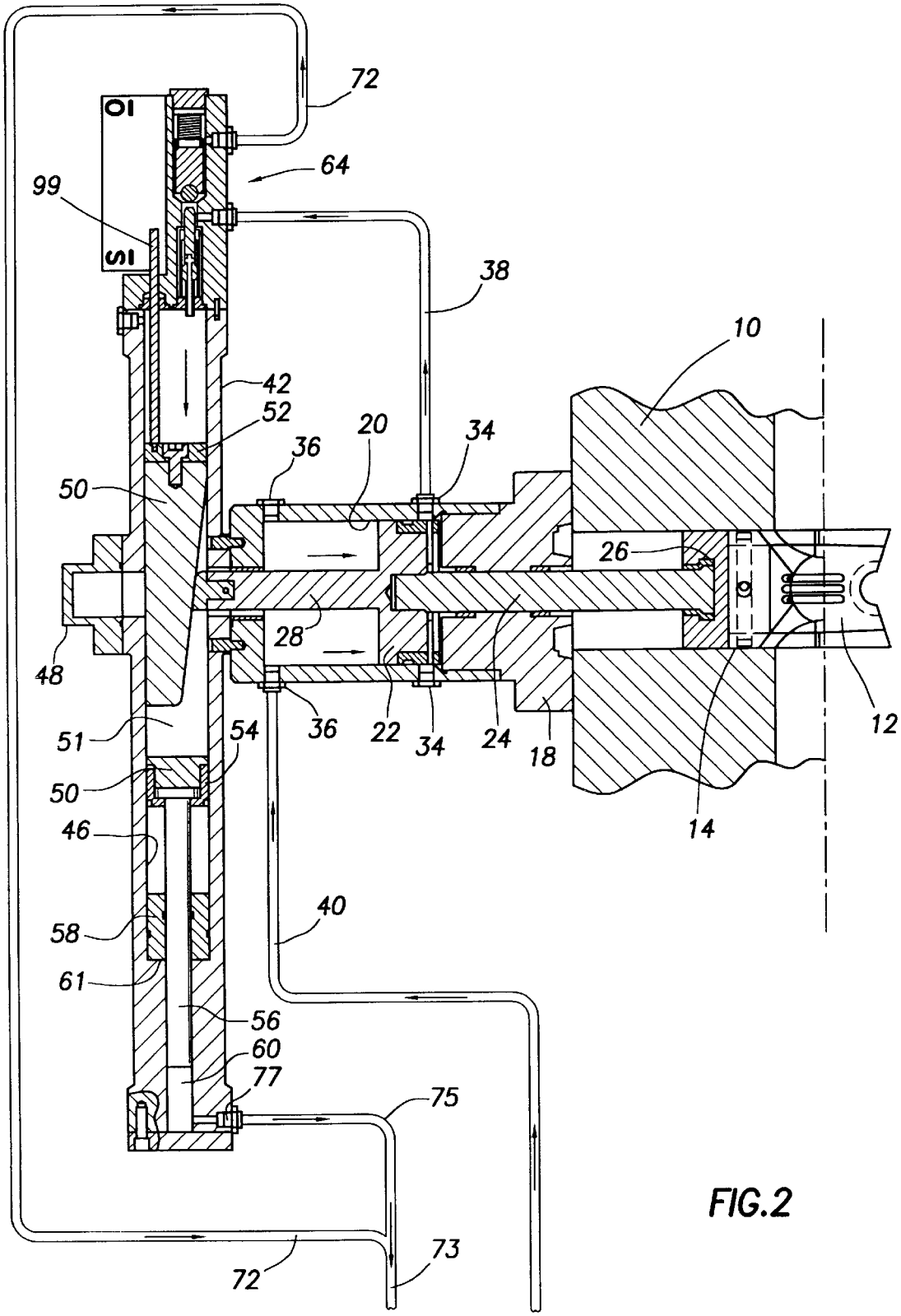
FIG. 2 is a top section view of an actuator of the present invention with a ram in the closed position with the locking mechanism oriented horizontally.

The present invention will be described in detail as it relates to its use in connection with a blowout preventer as a fluid pressure operated actuator, and one such ram is depicted in FIGS. 1 and 2 of the drawings. To those skilled in the art, it will be understood that an additional ram and arrangement of the present invention will be employed to the left of that shown and the rams are diametrically opposed so that a pair of rams move toward each other to accomplish their desired function to seal off around a member in connection with drilling and production operations in oil and gas wells. In practice, one or more set of rams may be employed. A lock member will be used with each actuator for each ram.

Those skilled in the art will also appreciate that the present invention is applicable to actuators of a part to be moved, described herein as applied to a ram, but may also be applicable to other parts to be moved.

Figure 5A:
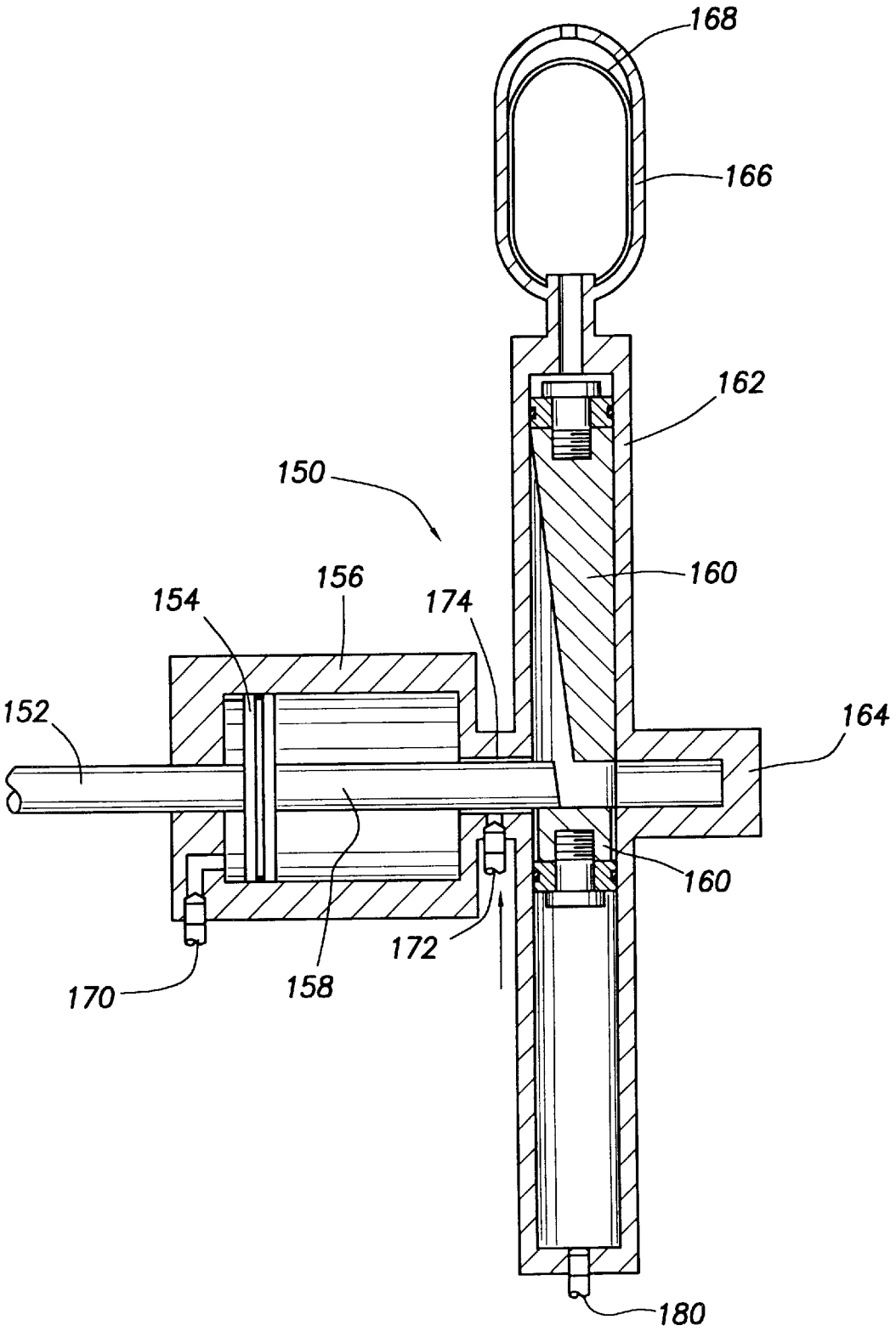
FIGS. 5*a* and 5*b* depict section views of a known locking wedge actuator that may become unlocked under the influence of the hydrostatic head of hydraulic fluid with a specific gravity greater than that of the ambient seawater around the actuator.
Figure 5B:
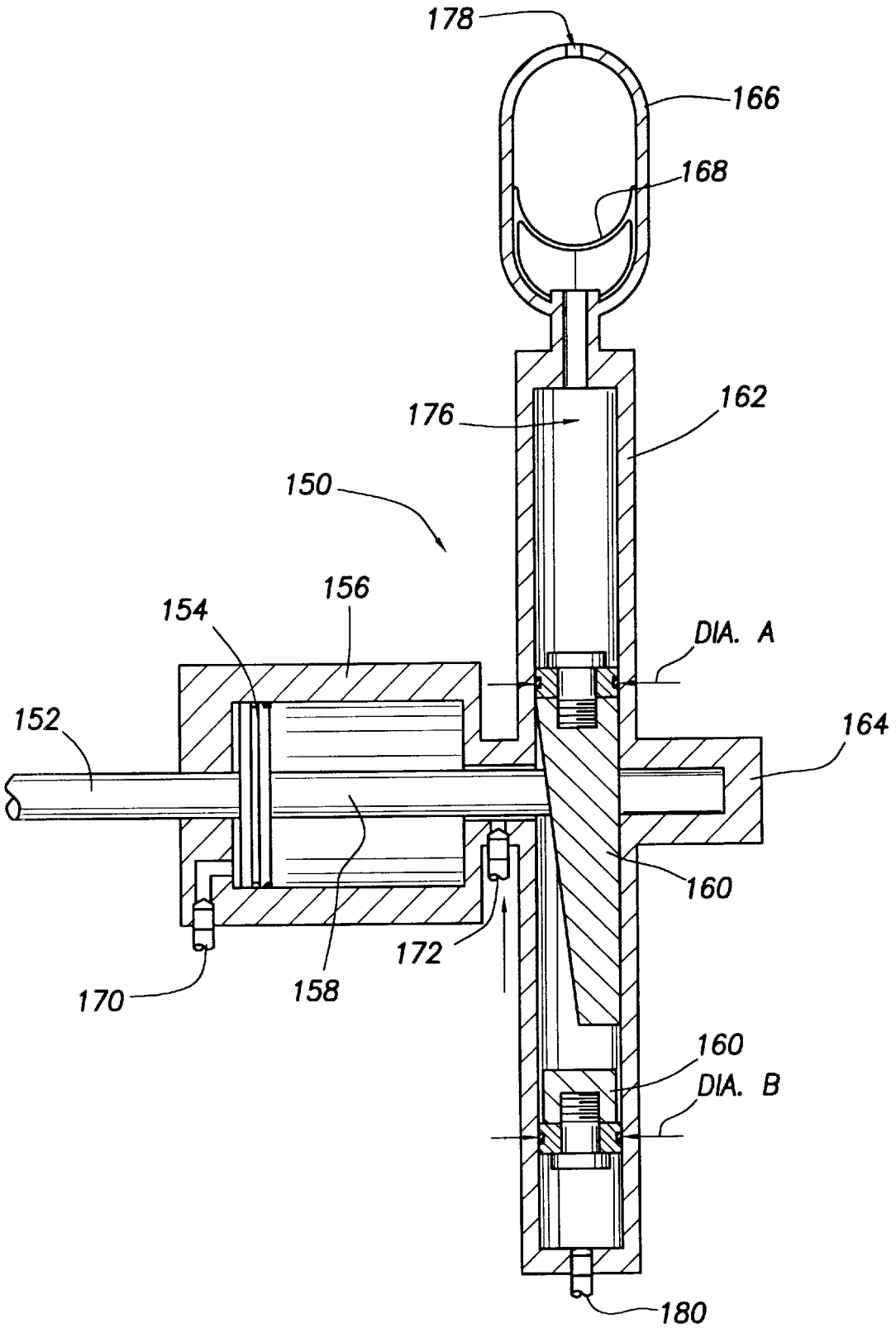

Before turning to the structure of a locking actuator which incorporates the present invention, an explanation of the actuator of FIG. 5*a* and 5*b* will show one problem of the prior which is solved by this invention.

FIGS. 5*a* and 5*b* depict an actuator 150 which is coupled to a ram (not shown) by way of a piston rod 152. The piston rod 152 extends from a piston 154 which is enclosed within a cylinder 156. On the opposite side of the piston 154 is a tail rod 158 which cooperates with a wedge 160 for locking the actuator. The wedge 160 is enclosed within a locking mechanism cylinder 162 which includes a bore 164 for receiving the tail rod 158. Attached to one end of the cylinder 162 is an expansion chamber 166 which encloses a rubber diaphragm or bladder 168. The diaphragm separates ambient seawater outside the diaphragm from the hydraulic fluid within it, maintaining the same hydrostatic pressure inside the wedge operator.

Operation of the BOP actuator and the wedge-type lock actuator is accomplished by variously porting hydraulic fluid to ports 170 and 172. As shown in FIG. 5*a*, porting hydraulic fluid to the port 172 moves the piston to the left in the figure, thus actuating the ram. The same hydraulic fluid flows around the tail rod through an orifice 174 into the cylinder 162. When the tail rod 158 clears the wedge 160, pressurized hydraulic fluid moves the wedge down, thus locking the wedge against the end of the tail rod. The diaphragm 168 simultaneously collapses by a volume equal to the volume of a chamber 176 within the cylinder 162. Seawater flows into expansion chamber 166 through an opening 178 as a result and hydraulic fluid is ported from a port 180. In this condition, the hydrostatic head of the seawater surrounding the actuator bears upon the locking mechanism at the region shown in FIG. 5*b* as Diameter A.

When hydraulic fluid pressure is released from the port 172, the locking mechanism will remain in the locked position so long as the pressure at Diameter A is equal to or greater than that at Diameter B, which experiences the hydrostatic pressure head of the hydraulic fluid. If this is greater than the head of ambient seawater, the wedge may be released from the locking position and the ram may be unactuated. It is this unsatisfactory condition that the present invention solves.

The Structure of a Locking Actuator

FIG. 1 depicts an actuator and associated ram wherein the locking mechanism for the actuator employs the present invention. A blowout preventer body 10 receives a ram 12 within an annular bore 14. A housing 16 extends laterally from the body by means of a mount 18, which is attached to the body 10 by any appropriate means, preferably by bolting the mount to the body. The housing 16 provides a cylinder 20 for receiving a piston 22. The cylinder 20 and the piston 22 provide a fluid actuator for actuating the ram 12, and a piston rod 24 is connected to one end of the piston 22 to extend through one end of the cylinder 20 and is also connected to the ram 12 by any suitable means such as indicated at 26. This structure is well known in the art.

A tail rod 28 extends from the piston 22 in the opposite direction relative to the piston rod 24 and extends through the opposite end of the cylinder 20 as shown. Any suitable bearing means 30 may be provided in the opening in the cylinder end through which the tail rod 28 extends.

The piston 22 is provided with suitable seal means 32 for accommodating sealable reciprocable movement of the piston 22 within the cylinder 20. A pair of ports 34 through the housing 16 provide access for hydraulic fluid on one side of the piston 22 and a similar pair of ports 36 provide access for hydraulic fluid on the other side of the piston 22. The ports 34 accommodate entry and exit of hydraulic fluid via a conduit 38. Similarly, the ports 36 accommodate entry and exit of hydraulic fluid via a conduit 40. The conduit connections to the lower port 34 and the upper port 36 are not shown for simplicity in the drawing of FIG. 1.

A locking mechanism body 42 is attached to the end of the housing 16 by any appropriate means, such as by bolts 44. The body 42 defines a cylinder 46 which provides a guideway that extends at a right angle to the cylinder 20. A locking mechanism body 42 is provided for each actuator, with one actuator per ram.

In FIGS. 1 and 2, a conventional BOP ram actuator is shown with the novel floating piston actuator of the present invention applied to wedge-type locking mechanism. The body 42 is provided with a bore 48 to receive the tail rod 28 when the ram is retracted (i.e., unactuated). A locking wedge 50 reciprocates within the cylinder 46 to lock and unlock the piston 22 relative to the cylinder 20 as described below. The wedge 50 has an opening 51 (see FIG. 2) formed therein to receive the tail rod 28 when the ram is retracted. As shown in FIGS. 1 and 2, the wedge 50 includes a wedge-shaped region above and another region below the opening so that, as shown in FIG. 1, the wedge-shaped region is disposed to one side of the tail rod when the ram is in the open position.

An annular member 52 is mounted on one end of the wedge 50. The drawing of FIG. 1 depicts the ram 12 in a top view, and thus the locking mechanism body 42 is oriented horizontally; the locking mechanism may also be oriented vertically, and thus the annular member 52 would in that orientation be mounted to the top of the wedge. Similarly, an annular member 54 is mounted to the opposite end of the wedge 50, or on the bottom of the wedge if it is oriented vertically. The annular member 52 provides a means of attaching a position indicator rod (see FIG. 3) to the wedge 50 and the annular member 54 provides a means of attaching the rod 56 to the wedge 50. This structure allows for lateral movement of the wedge 50 without unwanted lateral displacement of the piston rod 56.

Within the cylinder 46 and around the piston rod 56 is a free-floating piston 58. Permitting the piston 58 to freely slide up and down the piston rod 56 permits the design of an actuator which provides a greater variation of forces between the opening and closing operation. In one direction of travel, the piston 58 provides added force to the system. In the opposite direction, it de-couples in order to limit the force in that direction. The guide rod 56 reciprocates with the wedge 50 in its movement. The piston 58 reciprocates within the cylinder 46 independent of the movement of the wedge 50 and the guide rod 56.

Figure 2A:
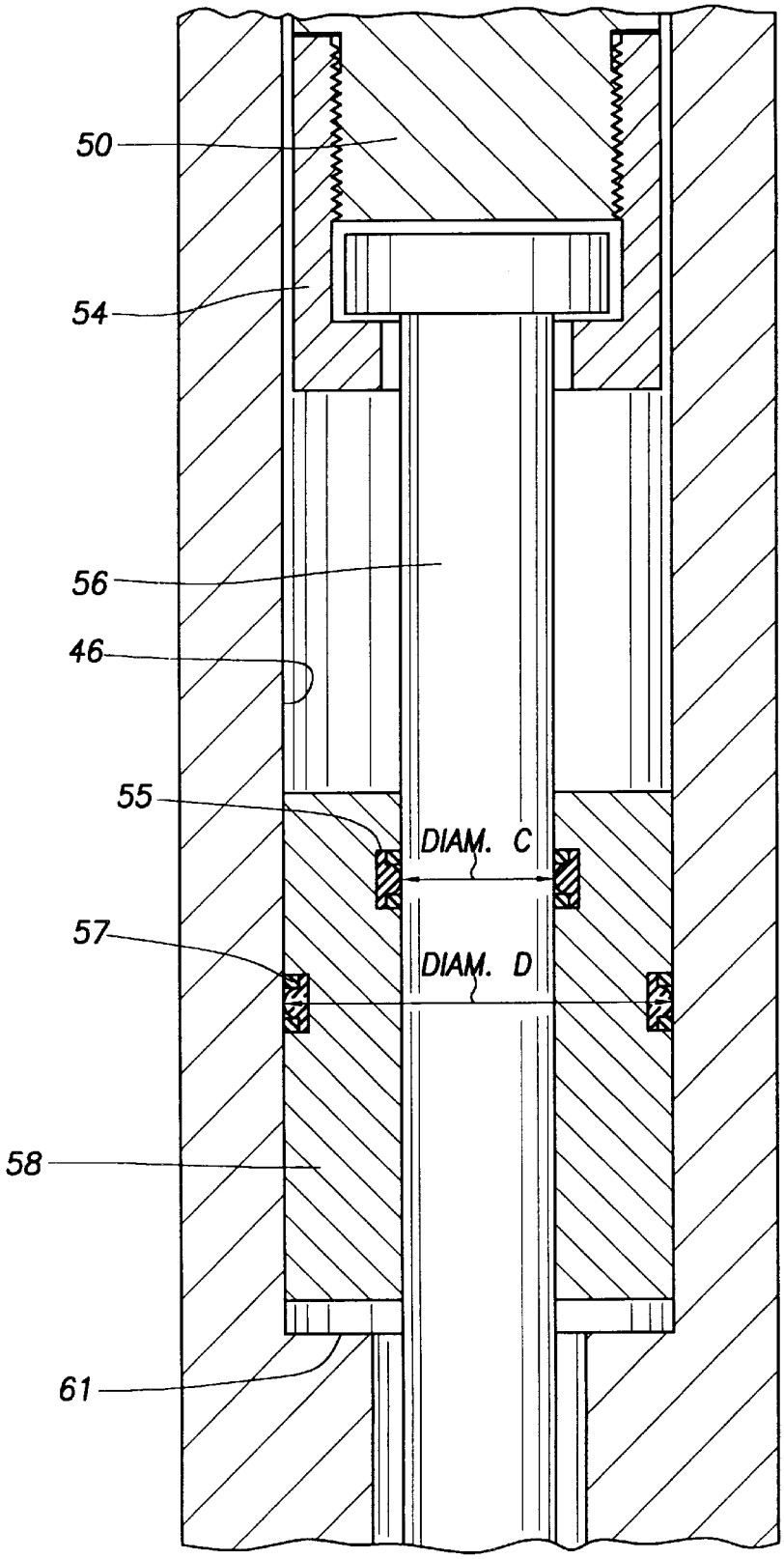
FIG. 2*a* is a detail section view of the floating piston of this invention.

FIG. 2*a* provides additional details of the piston 58 within the cylinder 46. The piston 58 is sealed to the rod 56 by an O-ring seal 55 and to the cylinder 46 by an O-ring seal 57. By this arrangement, any differential pressure on the piston 58 moves the piston, as will be described below with regard to the operation of the system.

The guide rod 56 retracts into a bore 60 when the wedge 50 moves down into a locking position. The bore 60 extends below a bottom shelf 61 on the cylinder 46. The end of the guide rod 56 is chamfered to mate with a countersink ledge on the entry into the bore 60 for ease of mating of the guide rod 56 with the bore 60. Further, the interior surface of the cylinder 46 has a hydraulic braking chamber 62 to prevent the piston 58 from slamming into the shelf 61.

The actuator is further provided with a sequencing valve 64. The sequencing valve 64 ensures, during an operation to retract the ram 12 (i.e. to withdraw the tail rod 28 into the bore 48, that the wedge 50 is properly aligned in the full up position (as depicted in FIG. 1) before porting pressurized hydraulic fluid into the port 34 for movement of the piston 22. In this way, the sequencing valve prevents the opening-sequence pressurized hydraulic fluid from starting the ram retraction, and excessive force of the piston tail rod upon the wedge, until the wedge has fully retracted to the open position as in FIG. 1. While desirable, the sequencing valve is not essential to the present invention, and an actuator with or without the sequencing valve which incorporates the novel piston arrangement herein described is fully within the scope of the present invention. Without a sequencing valve, a third hydraulic control line would be utilized to first release the wedge before applying hydraulic pressure to the other hydraulic line to open the ram.

Figure 3:
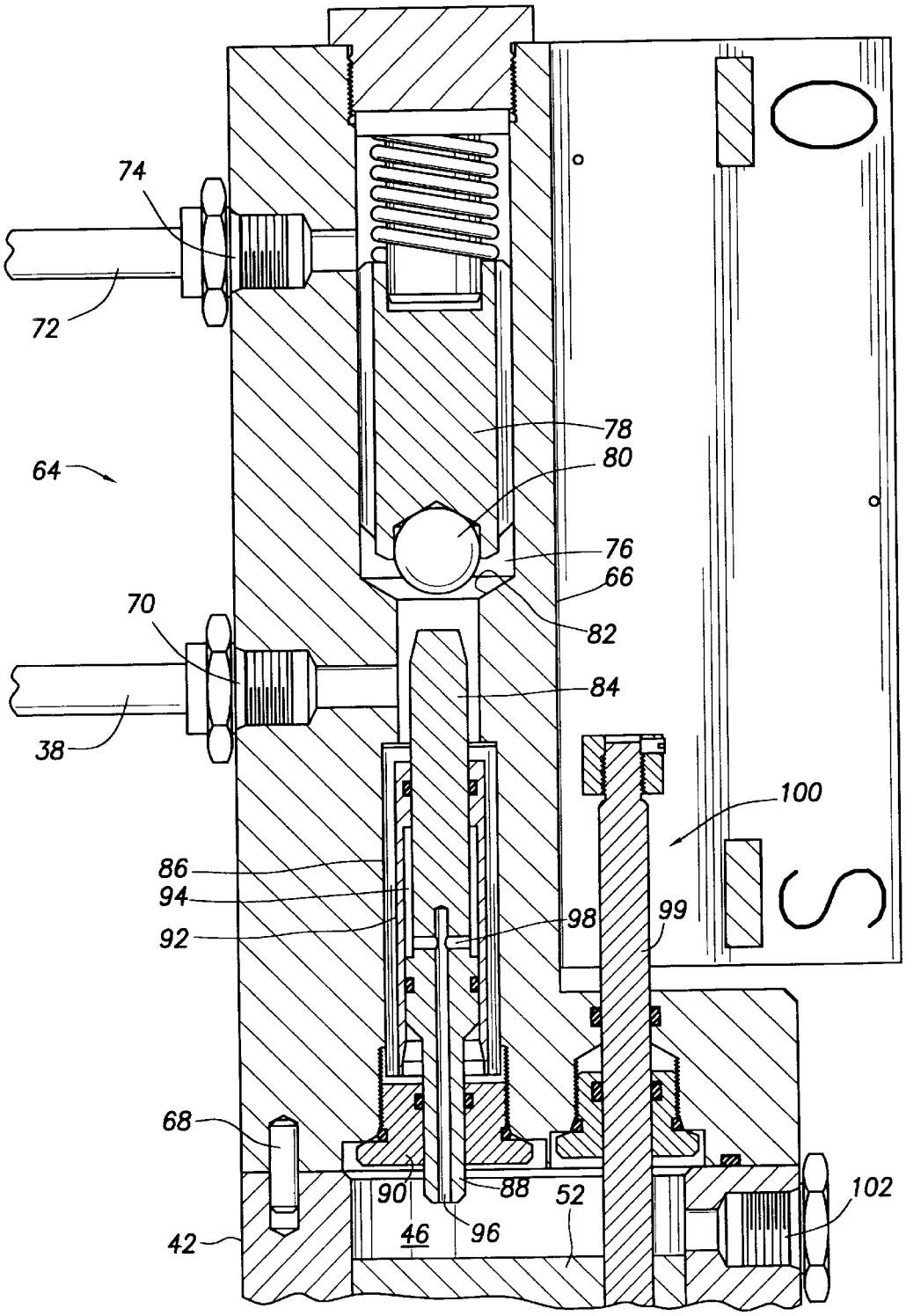
FIG. 3 is a detailed section view of a sequencing valve which finds application with the actuator of this invention.

The sequencing valve 64 is shown in greater detail in FIG. 3. The illustration of the sequencing valve of FIG. 3 is that of the closing sequence of FIG. 2, described below in greater detail.

The sequencing valve 64 comprises a valve body 66 mounted to the locking mechanism body 42 by any appropriate means, such as bolts 68. The hydraulic line 38 (see also FIG. 1) couples to a port 70 and a hydraulic line 72 couples to a port 74. The hydraulic line 72 is fed from a hydraulic line 73, which also provides hydraulic fluid to a line 75 which is coupled to a port 77 at the bottom of the bore 60. A chamber 76 encloses a check valve stem 78 which terminates in a ball 80. The ball 80 closes against a seat 82 to close off the chamber 76. The ball 80 may be forced off the seat 82 by a sequencing stem 84 which is enclosed within a chamber 86. An extension 88 from the stem 84 extends into the cylinder 46 of the locking mechanism body. The extension 88 is impacted by the top surface of the annular member 52 which is attached to the top of the wedge 50. The extension slides within a seal cap 90 which seals the lower end of the chamber 86. The extension 88 also rides within a sleeve 92 which forms a chamber 94 between the stem 84 and the sleeve 92. Fluid pressure between the cylinder 46 and the chamber 94 is communicated by an axial bore 96 through the stem 84 and a connecting radial bore 98.

The sequencing valve 64 further includes a position indicator 100 which penetrates the body 66 and is coupled to the annular member 52 so that the indicator 100 provides a visible indication of the position of the wedge 50. Another penetration of the body 66 is provided by a port 102 for flushing and maintenance of the interior of the locking mechanism.

Operation of the Invention

Referring now to FIGS. 1 and 2, the sequence of operations of the actuator will be described. FIG. 1 depicts the ram 12 in the open position (i.e., at the completion of the open stroke), and the various arrows depict hydraulic fluid flow and pressure for this operation. Hydraulic fluid is ported to the line 73 where it flows to both lines 72 and 75. To reach the position depicted in FIG. 1, imagine that the ram is first in the closed position shown in FIG. 2.

For the opening operation, fluid enters the system through the line 73 and into the line 75. Fluid the pressurizes the chamber 60 which moves the piston 58 to abut the underside of the wedge 50. Note that fluid pressure is acting upon the full area of the end of the rod 56 and the area of piston 58, providing full motive force to move the wedge 50 to the position shown in FIG. 1. This is the full area of the region shown as Diameter D in FIG. 2*a*.

With the wedge in the full up position of FIG. 1, the opening 51 aligns with the tail rod 28, and hydraulic fluid pressure through the line 38 ports hydraulic fluid to the cylinder 20, which moves the piston 22 to the left, thereby retracting the ram 12. The tail rod 28 then drives into opening 51, but only after the wedge 50 is properly positioned. Release of all fluid pressure from the hydraulic lines 73 and 40 leaves the actuator in the open position.

With the actuator beginning in the position shown in FIG. 1 and ending up in the position shown in FIG. 2 (i.e., closing the ram), fluid enters the cylinder 20 through line 40, moving the piston 22 and tail rod 24 forward (i.e., to the right in FIG. 2), closing the ram 12. The tail rod 24 is not sealed at the at the bearing means 30, so hydraulic fluid enters the cylinder 46 moving the floating piston 58 down, abutting the shoulder 61 in the cylinder 42. Note that the force for locking the wedge into a position where it locks the ram in place is effectively the force determined by the area of Diameter C as shown in FIG. 2*a*, which is less than the force for the opening operation. The wedge thus moves downward behind the tail rod 24 to complete the closing sequence.

Operation of the Sequencing Valve

As previously described, a sequencing valve 64 may be included with the system of FIGS. 1 and 2. The following description details the sequence of events in the sequencing valve for opening and closing operations.

For the opening operation, as the wedge 50 travels up toward the fully released position, the upper side of the annular member 52 strikes the stem extension 88 (FIG. 3). This drives the stem 84 up, thus moving the ball 80 off its seat 82. Hydraulic fluid may now flow through the line 72, into the port 74, out the port 70, and into the line 38.

For the opening operation and regarding the operation of the sequencing valve 64, previous designs of the sequencing valve have relied on a spring to hold the stem 84 away from the ball 80, until the wedge 50 contacts the stem extension 88 and forces the ball off of its seat 82. The sequencing valve shown in FIG. 3 changes the operation because, in the previous design, the pressure of hydraulic fluid in the chamber 46 tended to overpower the force of the spring, and prematurely open the sequencing valve. Pressure in chamber 46 acting on the end of the stem extension 88 tends to move the stem up to open valve by moving the ball 80 off of its seat 82. However, hydraulic fluid in chamber 46 also travels through the axial bore 96, exits through the radial bore 98, and pressurizes the annular chamber 94. The net area of the annular chamber 94 is greater than the area of the stem extension 88, so the resultant force avoids contact between the stem 84 and the ball 80.

When the wedge 50 travels to the fully open position, the annular member 52 contacts the stem extension 88, moves upward so that the stem 84 contacts the ball 80, permitting flow of pressurized hydraulic fluid through the line 38 to force the piston 22 to the open position.

For the closing sequence, pressurization of the line 38 forces the ball off the seat, independent of any action of the stem 84, to permits fluid flow through the port 74 to the line 72.

BOP Operator

Figure 4A:
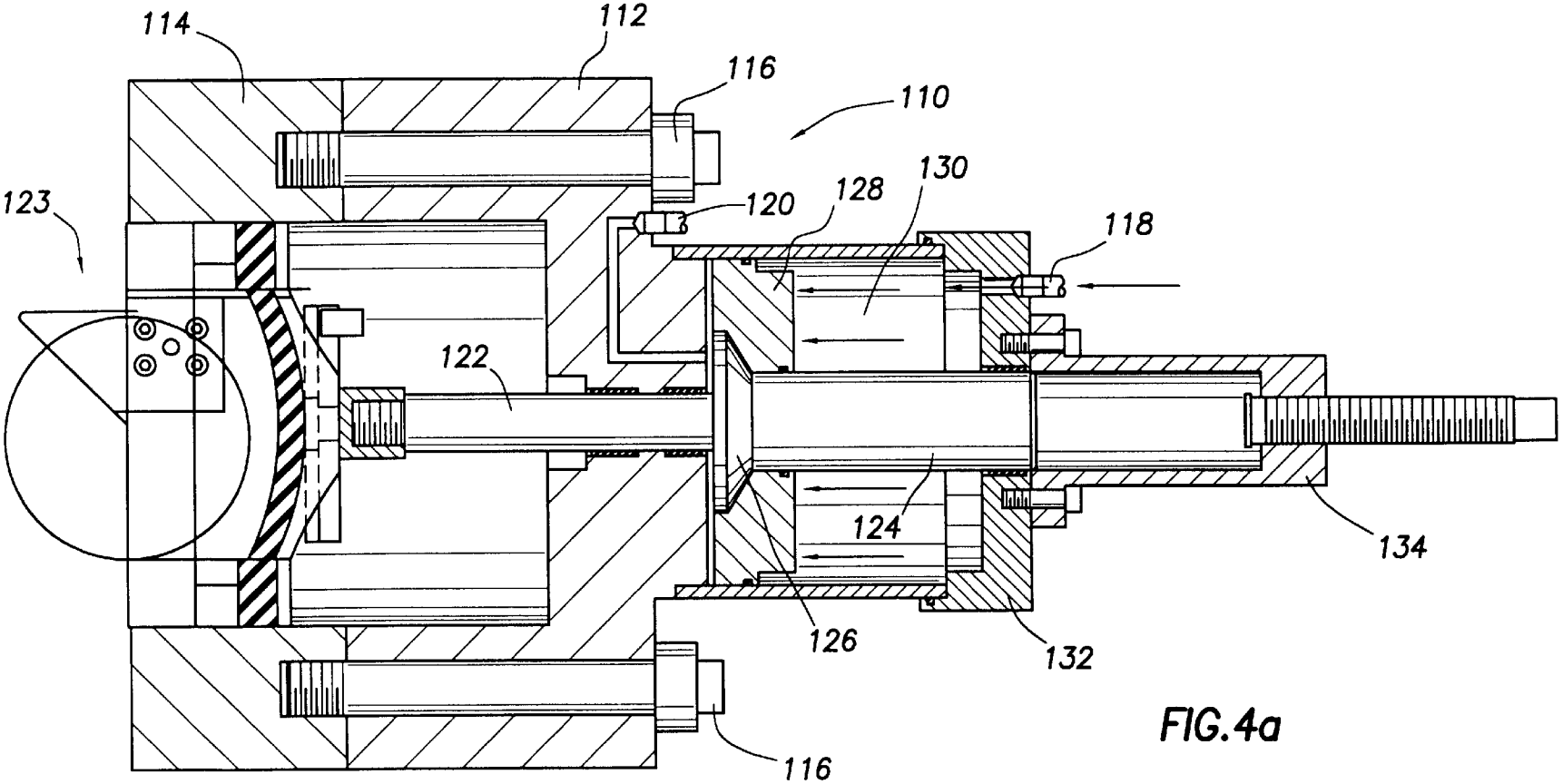
FIGS. 4*a* through 4*c* depict top section views of a blowout preventer to which the present invention has been applied.
Figure 4B:
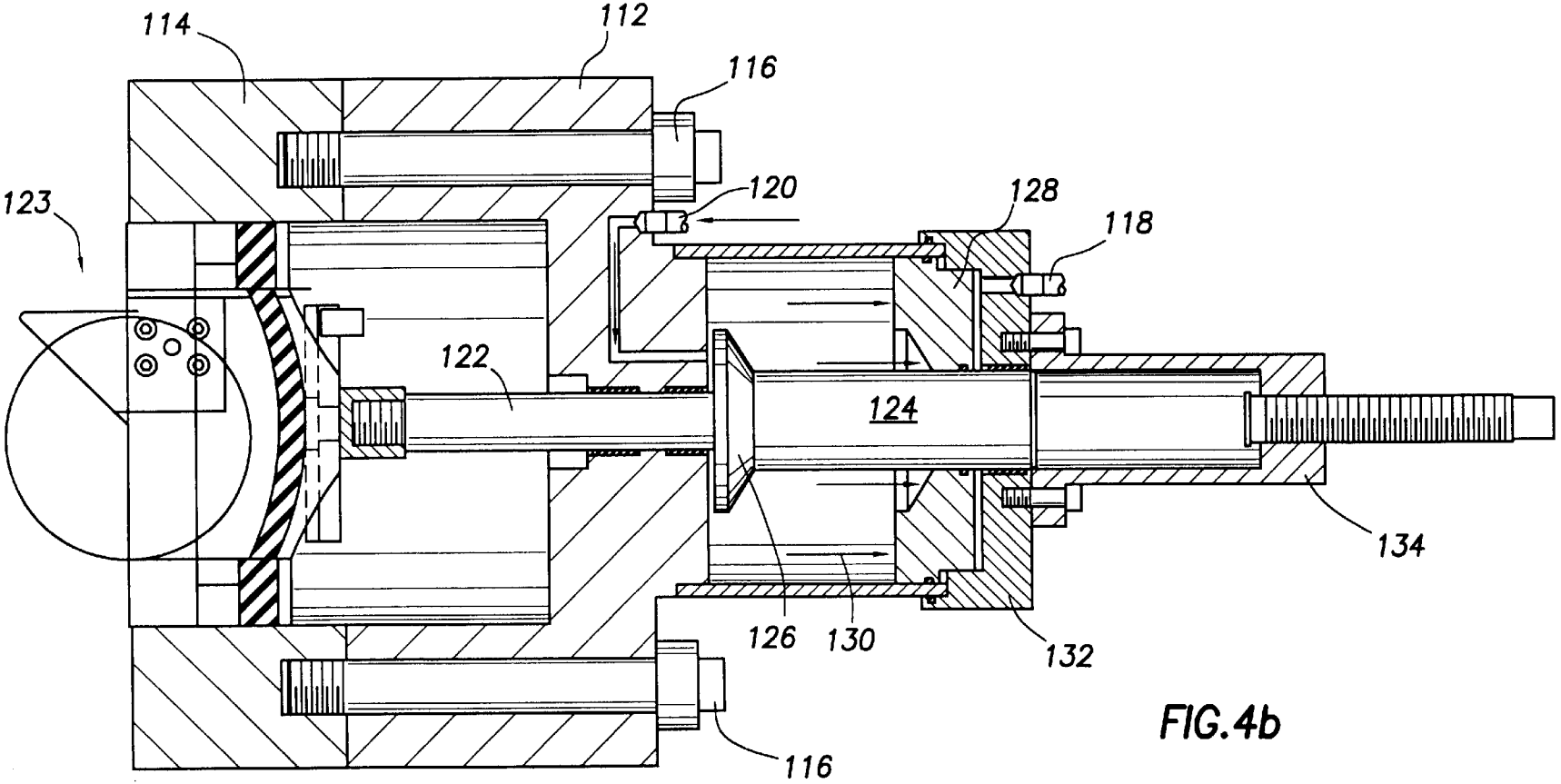
Figure 4C:
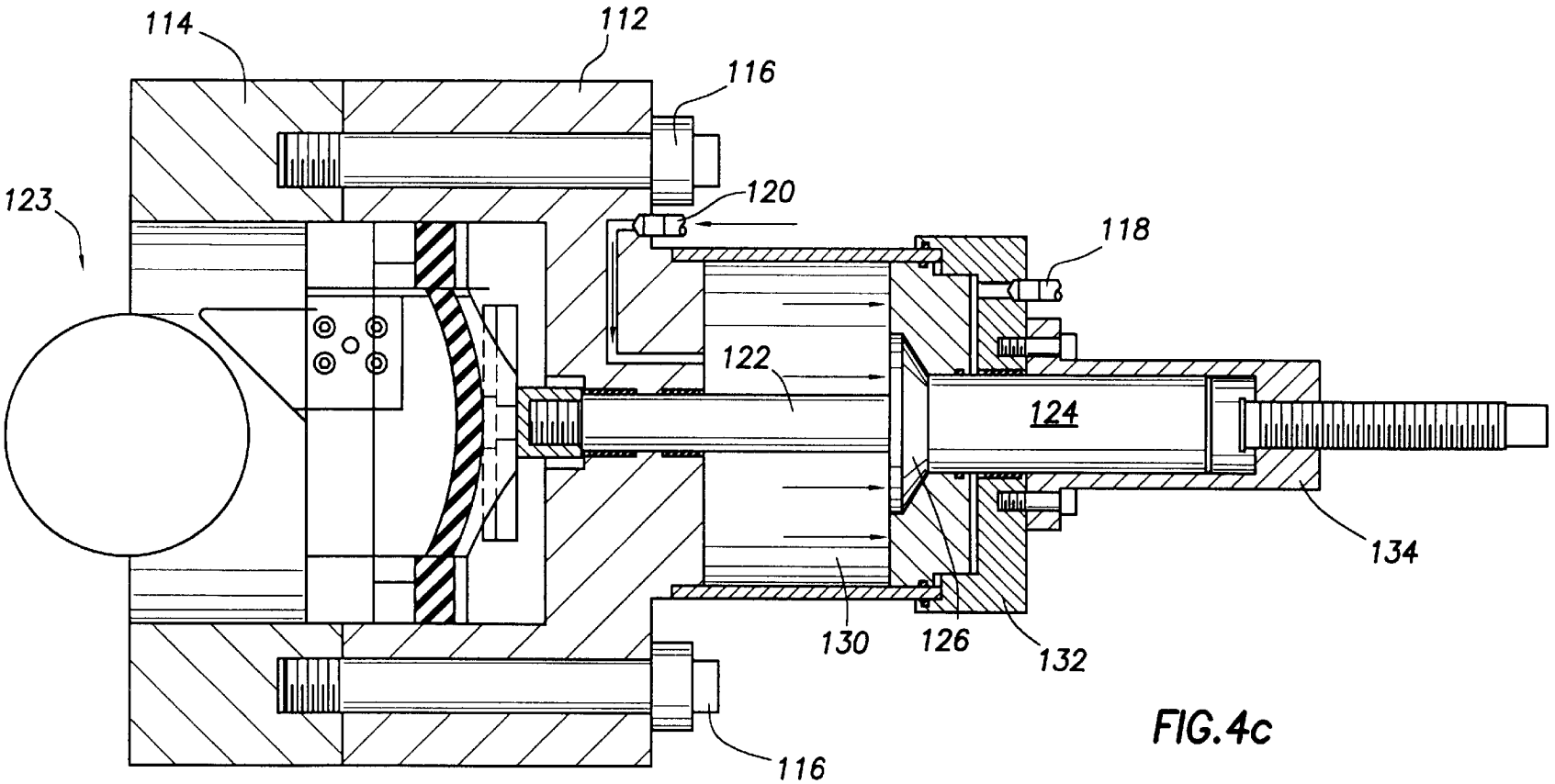

A novel hydraulic operator 110 illustrated in FIG. 4*a*, 4*b*, and 4*c* solves the dilemma of the compromise between opening and closing forces in a BOP. FIG. 4*a* depicts a hydraulic operator using this invention with the operator in the closed position. FIG. 4*b* depicts the operator during an opening operation and FIG. 4*c* shows the operator in the open position.

The operator 110 includes an actuator body 112 coupled to a BOP body 114 by any appropriate means such as by bolts 116. Pressurized hydraulic fluid is provided by a port 118 and a port 120, both of which penetrate the actuator body 112. Within the actuator body are a piston rod 122 coupled to a ram 123, a guide rod 124, and a contiguous flange 126 between the piston rod 122 and the guide rod 124. Note that the diameter of the piston rod 122 is smaller than the diameter of the guide rod 124. Mounted on the guide rod 124 for sliding reciprocal movement thereon is a free-floating piston 128 within a cylinder 130. The port 118 and the port 120 provide access for hydraulic fluid into the cylinder 130 in either side of the free-floating piston, respectively. The cylinder 130 is enclosed at one end by an end cap 132, to which is attached a bore housing 134 to receive the guide rod as the ram 123 is opened.

With the operator 110 beginning as shown in FIG. 4*a*, hydraulic fluid is ported to the port 120 and vented from the port 118. The free-floating piston is driven through its entire stroke along the guide rod to its open set position, and then the piston rod/guide rod/flange member begins to stroke. The force of this stroke is determined by the fluid pressure and is a function of the difference between the diameter of the piston rod and the diameter of the guide rod, a force that is smaller than the closing force for the opposite procedure.

To close the ram, hydraulic fluid is ported to the port 118 and permitted to vent from the port 120. Since the free-floating piston is now constrained in its movement by the flange 126, the closing force is determined by the hydraulic fluid pressure and the difference between the bore of the cylinder 130 and the diameter of the guide rod, a force that is much greater than the opening force.

By carefully selecting the diameters of the cylinder 130, the piston rod 122, and the guide rod 124, one may tailor the opening force relatively independently of the closing force, while ensuring the integrity of all of the components of the operator.

Those of skill in the art will appreciate that the floating piston actuator for the wedge-type lock may be used with a conventional BOP ram actuator, as shown in FIGS. 1 and 2, or with a floating piston BOP ram actuator, as shown in FIGS. 4*a*–4*c*.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A fluid actuator comprising:

a. an actuator body defining an actuator cylinder having opposing ends;

b. a piston in the actuator cylinder, the piston positionable between alternate positions within the actuator cylinder;

c. a rod on the piston extending through one end of the cylinder for connection with a part to be moved, and a tail rod on the piston having an outer end extending through the opposite end of the cylinder;

d. a lock member coupled to the actuator body, the lock member comprising:

i. a lock member body;

ii. a locking mechanism in the lock member body, the locking mechanism having a wedge reciprocable between a first position in which the wedge is disposed to one side of the tail rod, wherein the piston is moved to one of its alternate positions, and a second position in which the wedge is disposed across the outer end of the tail rod, as the piston is moved toward its other alternate position, iii. means for communicating actuating fluid to the cylinder and to the locking mechanism which maintains the wedge and the tail rod outer end in locking relation as the piston moves to and is in the other alternate position;

iv. means including passage means and normally closed valve means therein for controlling communication of actuation fluid to the cylinder for moving the piston to the one alternate position;

v. means for communicating actuating fluid to the locking mechanism for moving the lock member to the first position;

vi. means operable by the locking mechanism wherein it is moved to the first position to open the valve means and communicate actuating fluid to the cylinder to move the piston to the one alternate position; and vii. a floating piston in the lock member body, wherein the floating piston disengages the wedge in one direction of travel, in order to reduce the effective working area of the floating piston, but engages the wedge in the opposite direction of travel in order to increase the effective area exposed to the hydraulic pressure for movement of the wedge.

2. The actuator of claim 1, further comprising a sequencing valve on the lock member body for controlling the flow of hydraulic fluid to and from the locking member and the cylinder.

3. The actuator of claim 1, wherein the floating piston defines an effective hydraulic surface area that is less than the cross-sectional area of the locking member body.

4. The actuator of claim 1, further comprising a hydraulic braking chamber in the lock member body to brake the speed of travel of the floating piston.

5. The actuator of claim 1 wherein the part to be moved comprises a ram of a blowout preventer.

6. A hydraulic operator for reciprocally moving a part, the operator comprising:

a. an operator body defining a cylinder with a cylindrical body wall and first and second ends;

b. a unitary rod defining a piston rod, a tail rod, and a flange between the piston rod and the tail rod, wherein the tail rod and the flange are within the cylinder, and wherein the piston rod penetrates the first end of the cylinder for coupling to the part;

c. a free-floating piston mounted on the guide rod between the flange and the second end of the cylinder body for sliding movement on the tail rod; and d. a first hydraulic fluid port through the first end of the cylinder and a second hydraulic fluid port through the second end of the cylinder.

7. The actuator of claim 6, wherein the piston defines an effective hydraulic surface area that is less than the cross-sectional area of the cylinder.

8. The actuator of claim 6, further comprising a hydraulic braking chamber in the cylinder to brake the speed of travel of the piston.

9. The actuator of claim 6 wherein the part to be moved comprises a ram of a blowout preventer.

10. A fluid actuator comprising:

a. an actuator body defining an actuator cylinder having opposing ends;

b. a flange in the actuator cylinder, the flange positionable between alternate positions within the actuator cylinder;

c. a piston rod on the flange extending through one end of the cylinder for connection with a part to be moved, and a tail rod on the piston having an outer end extending through the opposite end of the cylinder;

d. an actuator piston mounted on the tail rod between the flange and the opposite end of the cylinder body for sliding movement on the tail rod;

e. a lock member coupled to the actuator body, the lock member comprising:

i. a lock member body;

ii. a locking mechanism in the lock member body, the locking mechanism having a wedge reciprocable between a first position in which the wedge is disposed to one side of the tail rod, wherein the piston is moved to one of its alternate positions, and a second position in which the wedge is disposed across the outer end of the tail rod, as the piston is moved toward its other alternate position, iii. means for communicating actuating fluid to the cylinder and to the locking mechanism which maintains the wedge and the tail rod outer end in locking relation as the piston moves to and is in the other alternate position;

iv. means including passage means and normally closed valve means therein for controlling communication of actuation fluid to the cylinder for moving the piston to the one alternate position;

v. means for communicating actuating fluid to the locking mechanism for moving the lock member to the first position;

vi. means operable by the locking mechanism wherein it is moved to the first position to open the valve means and communicate actuating fluid to the cylinder to move the piston to the one alternate position; and vii. a lock mechanism piston in the locking mechanism which disengages the wedge in one direction of travel, in order to reduce the effective working area of the lock mechanism piston, but engages the wedge in the opposite direction of travel in order to increase the effective area exposed to the hydraulic pressure for movement of the wedge.

11. The actuator of claim 10, wherein the actuator piston defines an effective hydraulic surface area that is less than the cross-sectional area of the actuator cylinder.

12. The actuator of claim 10, further comprising a hydraulic braking chamber in the actuator cylinder to brake the speed of travel of the actuator piston.

13. The actuator of claim 10 wherein the part to be moved comprises a ram of a blowout preventer.

* * * * *